US007764920B2

(12) United States Patent
Lin et al.

(10) Patent No.: US 7,764,920 B2
(45) Date of Patent: Jul. 27, 2010

(54) DUPLEX DOCUMENT FEEDER

(75) Inventors: Hsien-Chi Lin, Taichung (TW); Kung-Hsin Teng, Taichung (TW); Heng-Hsiang Chang, Taichung (TW)

(73) Assignee: Asia Optical Co., Inc., Taichung (TW)

( * ) Notice: Subject to any disclaimer, the term of this patent is extended or adjusted under 35 U.S.C. 154(b) by 495 days.

(21) Appl. No.: 11/900,553

(22) Filed: Sep. 12, 2007

(65) Prior Publication Data

US 2008/0085141 A1 Apr. 10, 2008

(30) Foreign Application Priority Data

Oct. 4, 2006 (TW) ..... 95136895 A

(51) Int. Cl.
*G15G 15/00* (2006.01)

(52) U.S. Cl. ..... 399/374; 399/364

(58) Field of Classification Search ..... 399/374, 399/364

See application file for complete search history.

(56) References Cited

U.S. PATENT DOCUMENTS

| | | | | |
|---|---|---|---|---|
| 5,486,911 | A * | 1/1996 | Rubscha et al. | 399/364 |
| 5,669,056 | A * | 9/1997 | Rubscha | 399/367 |
| 5,784,680 | A * | 7/1998 | Taruki | 399/374 |
| 5,791,645 | A * | 8/1998 | Takada | 271/3.03 |
| 5,887,865 | A * | 3/1999 | Ishimaru | 271/4.1 |
| 6,434,359 | B2 * | 8/2002 | Nose et al. | 399/374 |
| 7,522,871 | B2 * | 4/2009 | Tu | 399/374 |
| 2007/0020007 | A1 * | 1/2007 | Azuma | 399/367 |

* cited by examiner

*Primary Examiner*—Anthony H. Nguyen
(74) *Attorney, Agent, or Firm*—Trop, Pruner & Hu, P.C.

(57) ABSTRACT

A duplex document feeder includes a housing unit, and a switching unit. The housing unit has a document-conveying path, an inverting path, and a switchback path. The switching unit is disposed in the switchback path, and includes a first switching gate, a second switching gate connected fixedly to the first switching gate, and a guiding path disposed between the first and second switching gates. The switching unit is pivotable among first, second, and third positions so as to allow for automatic feeding, two-sided scanning, inverting, and ejecting in orderly arrangement of documents.

10 Claims, 6 Drawing Sheets

DUPLEX DOCUMENT FEEDER

CROSS-REFERENCE TO RELATED APPLICATION

This application claims priority of Taiwanese Application No. 095136895, filed on Oct. 4, 2006.

BACKGROUND OF THE INVENTION

1. Field of the Invention

This invention relates to an office machine, and more particularly to a duplex document feeder cooperating with a scanning unit so as to perform a two-sided scanning operation.

2. Description of the Related Art

Referring to FIG. 1, an auto-document feeder disclosed in U.S. Pat. No. 5,784,680 is employed for an image forming apparatus 1, and includes a housing unit 2, a first transfer path 301 disposed in the housing unit 2, a second transfer path 302 in spatial communication with the first transfer path 301, an inverting path 303 disposed above the second transfer path 302, a switchback path 304 intercommunicating and external to the second transfer path 302 and the inverting path 303, a document-feeding roller unit 4 aligned with the first transfer path 301, a first conveying roller unit 501 disposed in the first transfer path 301, a second conveying roller unit 502 disposed in the second transfer path 302, an ejecting roller unit 6 disposed between the second transfer path 302 and the inverting path 303, a switchback roller unit 7 external to the ejecting roller unit 6, a first switching gate 8 disposed between the ejecting roller unit 6 and the switchback roller unit 7, and an inverting unit 9 internal to the ejecting roller unit 6. The housing unit 2 includes a document-setting tray 201, a guiding tray 202 disposed under the document-setting tray 201, and an ejection tray 203. The first switching gate 8 is pivotable between an upper position shown by the solid lines and proximate to the switchback path 304, and a lower position shown by the phantom lines and distal from the switchback path 304. The inverting unit 9 includes a curved path 901' adjacent to the ejecting roller unit 6, and a second switching gate 902' disposed at a junction between the curved path 901' and the inverting path 303. The second switching gate 902' is pivotable into the inverting path 303 so as to interrupt communication between the inverting path 303 and the switchback path 304, and is removable from the inverting path 303 so as to allow for communication between the inverting path 303 and the switchback path 304.

When it is desired to perform a two-sided scanning operation, a stack of documents is placed on the document-setting tray 201 in such a manner that first surfaces (I) of the documents face upwardly. The first switching gate 8 is initially disposed in the lower position. When a first sensor unit 901 detects the presence of the documents on the document-setting tray 201 to thereby output a signal to a controller (not shown), the document-feeding roller unit 4 is driven by the controller to move the uppermost document into the first transfer path 301. Also under control of the controller, the first conveying roller unit 501 moves the uppermost document to pass through a second sensor unit 902 and a scanning window 101 of the image forming apparatus 1. Upon receiving a signal from the second sensor unit 902, the controller activates a scanning unit 102 so as to perform a scanning operation on the first surface (I) of the uppermost document. The uppermost document is moved from the second transfer path 302 into the switchback path 304 through operation of the second conveying roller unit 502 and the ejecting roller unit 6, and subsequently toward the guiding tray 202 through operation of the switchback roller unit 7. At this time, the first surface (I) of the uppermost document faces downwardly, and a second surface (II) opposite to the first surface (I) faces upwardly.

Thereafter, when a third sensor 903 detects alignment of a trailing end of the uppermost document therewith, or when a fourth sensor 904 detects that the trailing end of the uppermost document has passed therethrough for a predetermined time period, under control of the controller, the rotational direction of each of rollers of the switchback roller unit 7 is reversed, and the first switching gate 8 is pivoted to the upper position so as to move the uppermost document into the first transfer path 301 via the inverting path 303.

When the uppermost document passes through the second sensor 902 once again, a scanning operation on the second surface (II) is performed, and the first switching gate 8 is pivoted to the lower position. Through operation of the second conveying roller unit 502 and the ejecting roller unit 6, the uppermost document is moved again into the switchback path 304 such that the first surface (I) faces upwardly, and the second surface (II) faces downwardly.

Thereafter, when the third sensor unit 903 detects alignment of the trailing end of the uppermost document therewith, under control of the controller, the rotational direction of each of the rollers of the switchback roller unit 7 is reversed, and the second switching gate 902' is pivoted to the upper position (i.e., extends into the inverting path 303). Hence, the uppermost document moves along the curved path 901', and drops onto the ejection tray 203. As a result, the first surface (I) of the uppermost document faces downwardly, and the second surface (II) faces upwardly. Thus, when all of the documents are ejected, they are arranged orderly.

The auto-document feeder has the following disadvantages:

(1) To invert the documents after completion of two-sided scanning, a large number of elements are needed to cooperate with the curved path 901' and the second switching gate 902', thereby resulting in a complicated structure.

(2) The curvature radius of the curved path 901' is small. Therefore, it is difficult for the documents to be ejected fully. In other words, paper jams easily occur. Furthermore, when the documents pass through the ejecting roller unit 6 to thereby drop onto the ejection tray 203, they are easily curled.

(3) During operation, the documents are moved through an annular document path, which includes the switchback path 304, the inverting path 303, the second transfer path 302, and the switchback path 304, and which allows enter and exit of the documents via a nip defined by two rollers of the switchback roller unit 7. Provided that the length of the annular document path is shorter than the documents, when a two-sided scanning operation is performed on one document, the leading and trailing ends thereof may overlap each other on the switchback roller unit 7, thereby resulting in a paper jam. Thus, the length of the annular document path (P) must be longer than the largest document that the image forming apparatus is designed to handle. This increases significantly the whole length and volume of the duplex document feeder.

SUMMARY OF THE INVENTION

The object of this invention is to provide a duplex document feeder that can overcome the above-mentioned disadvantages associated with the prior art.

According to this invention, there is provided a duplex document feeder adapted for an image forming apparatus. The image forming apparatus includes a scanning unit. The duplex document feeder comprises:

a housing unit having a document-conveying path, an inverting path in spatial communication with an intermediate portion of the document-conveying path, and a switchback path located at one side of an assembly of the document-conveying path and the inverting path, the document-conveying path having a document-feeding end and a document-discharging end, the inverting path having an inlet end aligned with the document-discharging end, and an outlet end in spatial communication with the document-conveying path, the switchback path being in spatial communication with the document-discharging end and the inlet end, the scanning unit being disposed between the outlet end and the document-discharging end; and a switching unit disposed pivotally in the switchback path and including a first switching gate, a second switching gate connected fixedly to and disposed under the first switching gate, and a guiding path disposed between the first and second switching gates, the switching unit being pivotable in the switchback path among a first position whereat a free end of the first switching gate is disposed under the document-discharging end such that a top portion of the first switching gate is in spatial communication with both the document-discharging end and the inlet end, a second position whereat the first switching gate is disposed in proximity to the inlet end such that the inlet end is in spatial communication with the top portion of the first switching gate and whereat the document-discharging end is in spatial communication with the guiding path, and a third position whereat the guiding path is aligned with the inlet end such that the inlet end is in spatial communication with the guiding path and whereat the document-discharging end is in spatial communication with a bottom portion of the second switching gate.

As such, the switching unit is pivotable among the first, second, and third positions so as to allow for automatic feeding, two-sided scanning, inverting, and ejecting in orderly arrangement of documents.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
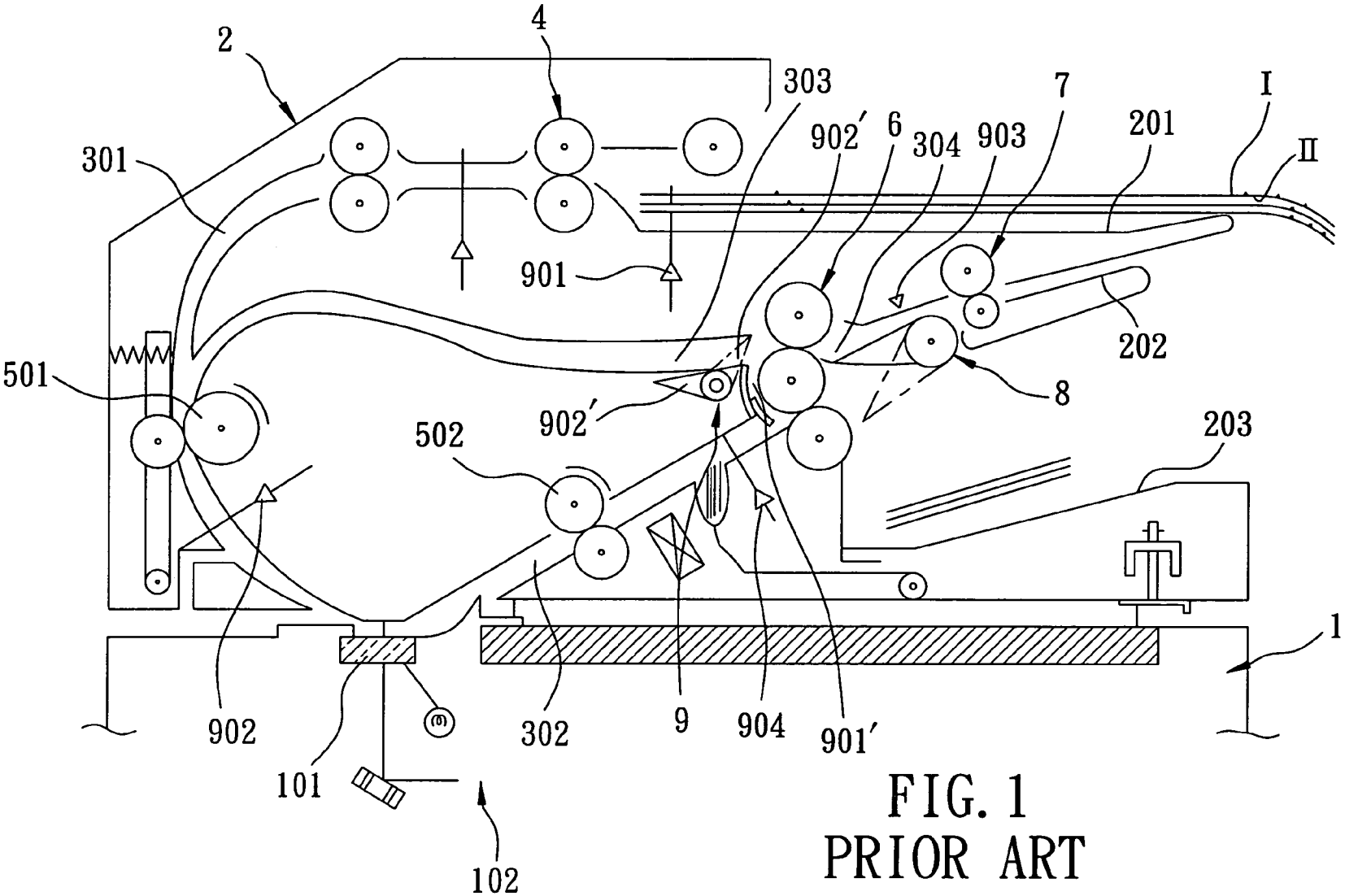
FIG. 1 PRIOR ART
FIG. 1 is a schematic view of a conventional duplex document feeder disclosed in U.S. Pat. No. 5,784,680.
Figure 2:
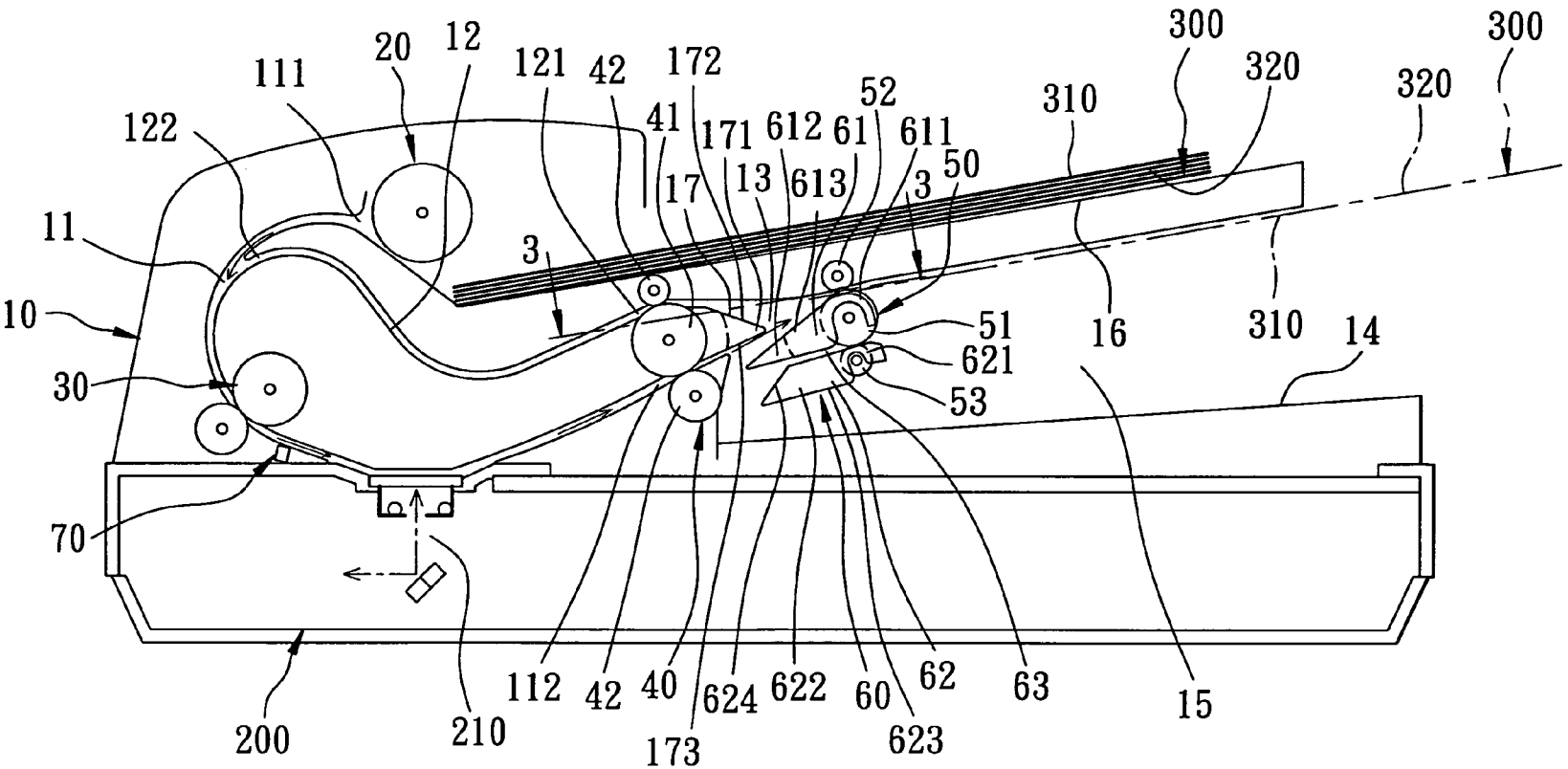
FIG. 2 is a schematic view of the preferred embodiment of a duplex document feeder according to this invention when a switching unit is disposed in a first position.

Referring to FIG. 2, the preferred embodiment of a duplex document feeder according to this invention is mounted on an image forming apparatus 200 (such as a copier or scanner) for automatic feeding and two-sided scanning of documents 300 each having a first surface 310 and a second surface 320. The image forming apparatus 200 includes a scanning unit 210. The duplex document feeder includes a housing unit 10, a feeding roller unit 20 disposed in the housing unit 10, a conveying roller unit 30, an ejecting roller unit 40, a switchback roller unit 50, a switching unit 60, and a sensing unit 70.

The housing unit 10 has a generally C-shaped document-conveying path 11, an inverting path 12 in spatial communication with an intermediate portion of the document-conveying path 11, a switchback path 13 external to an assembly of the document-conveying path 11 and the inverting path 12, an ejecting tray 14 external to the document-conveying path 11, a switchback space 15 disposed directly above the ejecting tray 14, and a document-setting tray 16 disposed directly above the switchback space 15 and aligned with the document-conveying path 11. The document-conveying path 11 has a document-feeding end 111 and a document-discharging end 112 disposed below the document-feeding end 111. The inverting path 12 has an inlet end 121 aligned with the document-discharging end 112, and an outlet end 122 in spatial communication with the document-conveying path 11. The switchback path 13 is in spatial communication with the document-discharging end 112 and the inlet end 121. The housing unit 10 further has a triangular guiding member 17 disposed between and in proximity to the inlet end 121 and the document-discharging end 112. The guiding member 17 extends into the switchback path 13, and has a plurality of spaced-apart guiding paws 171 interconnected fixedly, a top surface 172 disposed in proximity to the inlet end 121, and a bottom surface 173 disposed in proximity to the document-discharging end 112. The scanning unit 210 is disposed between the outlet end 122 and the document-discharging end 112, and is disposed in a bottom end of the housing unit 10.

The feeding roller unit 20 is disposed at the document-feeding end 111.

The conveying roller unit 30 is disposed between the outlet end 122 and the scanning unit 210.

The ejecting roller unit 40 is disposed in the switchback path 13, and includes a first driving roller 41 and two first follower rollers 42 located respectively to two opposite sides of the first driving roller 41. When the first driving roller 41 is rotated in a direction, the first follower rollers 42 rotate in an opposite direction.

The switchback roller unit 50 is disposed in the switchback path 13 and in proximity to the switching unit 60, and includes a second driving roller 51 and a pair of upper and lower follower rollers 52, 53 disposed respectively above and under the second driving roller 51. When the second driving roller 51 is rotated in a direction, the upper and lower follower rollers 52 rotate in an opposite direction.

Figure 3:
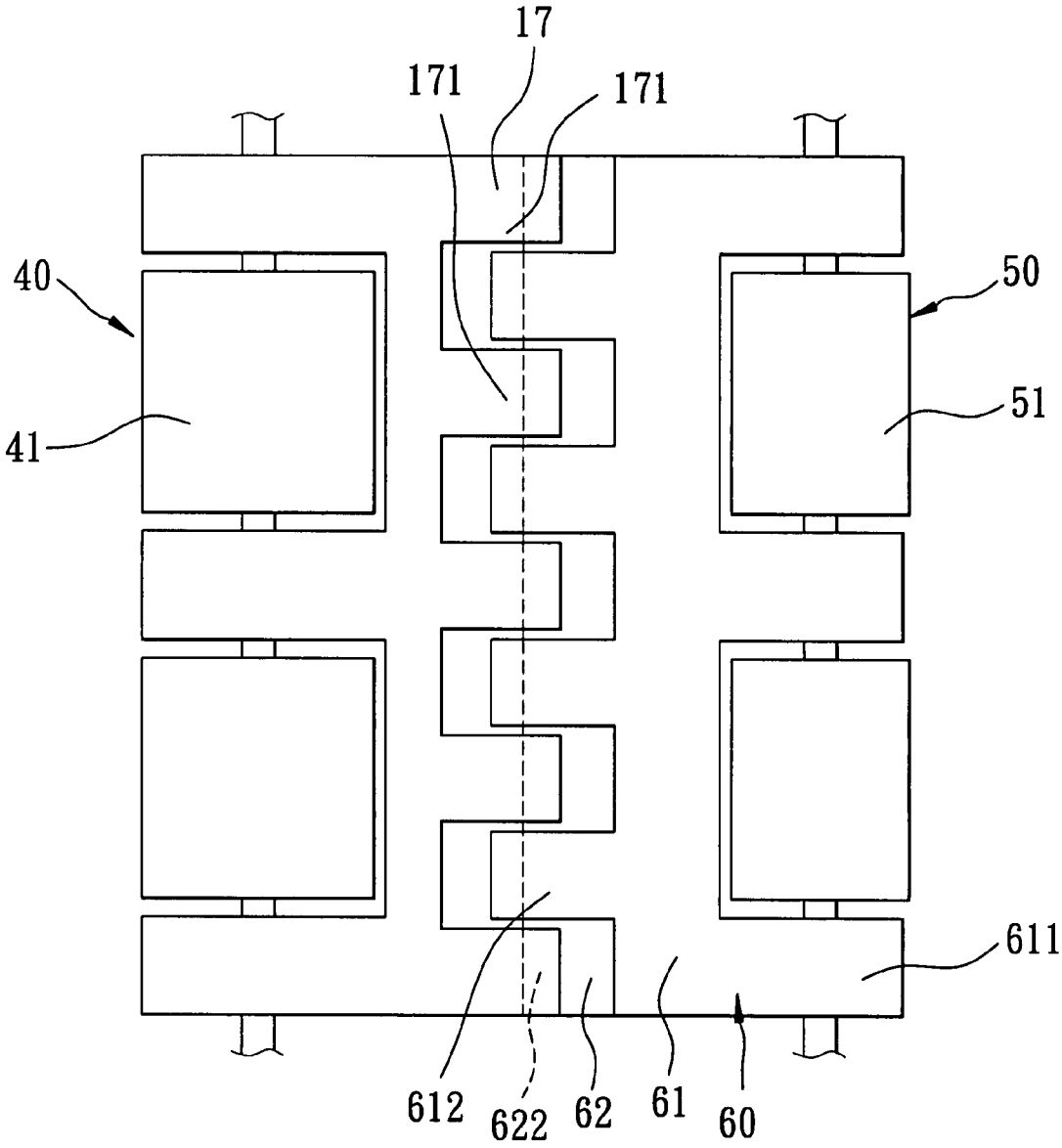
FIG. 3 is a sectional view taken along Line 3-3 in FIG. 2.

The switching unit 60 is disposed in the switchback path 13, and includes a first switching gate 61 coaxial with the upper follower roller 52, a second switching gate 62 connected fixedly to and disposed under the first switching gate 61 and coaxial with the lower follower roller 53, and a guiding path 63 disposed between the first and second switching gates 61, 62. The first switching gate 61 has a first pivot portion 611 and a plurality of first paw plates 612 connected integrally to the first pivot portion 611. The first paw plates 612 and the guiding paws 171 are alternatively arranged, as shown in FIG. 3. Each of the first paw plates 612 has a first guiding surface 613 at a top portion thereof. The second switching gate 62 has a second pivot portion 621 and a second paw plate 622 having an area corresponding to the total area of the first paw plates 612. The second paw plate 622 has a lower guiding surface or bottom surface 623 distal from the guiding path 63, and a second guiding surface 624 disposed between the guiding path 63 and the lower guiding surface 623. The guiding path 63 is aligned with a nip defined between the second driving roller 51 and the lower follower roller 53. The switching unit 60 is pivotable in the switchback path 13 among a first position shown in FIG. 2, a second position shown in FIG. 4, and a third position shown in FIG. 5.

The sensing unit 70 is disposed in the document-conveying path 11 between the conveying roller unit 30 and the scanning unit 210.

The operation of the preferred embodiment will now be described.

With reference to FIG. 2, when it is desired to perform a two-sided scanning operation, the documents are placed on the document-setting tray 16 such that the first surfaces 310 face upwardly, and the second surfaces 320 face downwardly. The feeding roller unit 20 is driven by a power source (not shown) to move the uppermost document 300 into the document-conveying path 11. In the document-conveying path 11, the uppermost document 300 is moved toward the scanning unit 210 by the conveying roller unit 30. When the sensing unit 70 detects the presence of the uppermost document 300 (i.e., alignment of a leading end of the uppermost document 300 therewith at this time), the controller activates the scanning unit 210, and pivots the switching unit 60 to the first position. In the first position, a free end of the first switching gate 61 is disposed under the document-discharging end 112 such that the first guiding surfaces 613 of the first switching gate 61 are in spatial communication with both the document-discharging end 112 and the inlet end 121. At this time, under the control of the controller, the first driving roller 41 rotates counterclockwise, and the second driving roller 51 rotates clockwise. Hence, after the first surface 310 of the uppermost document 300 is scanned, it is moved from the document-discharging end 112 into the switchback path 13. Thereafter, the uppermost document 300 is passed partially through a nip defined between the second driving roller 51 and the upper follower roller 52 such that the first surface 310 faces downwardly, and the second surface 320 faces upwardly.

Figure 4:
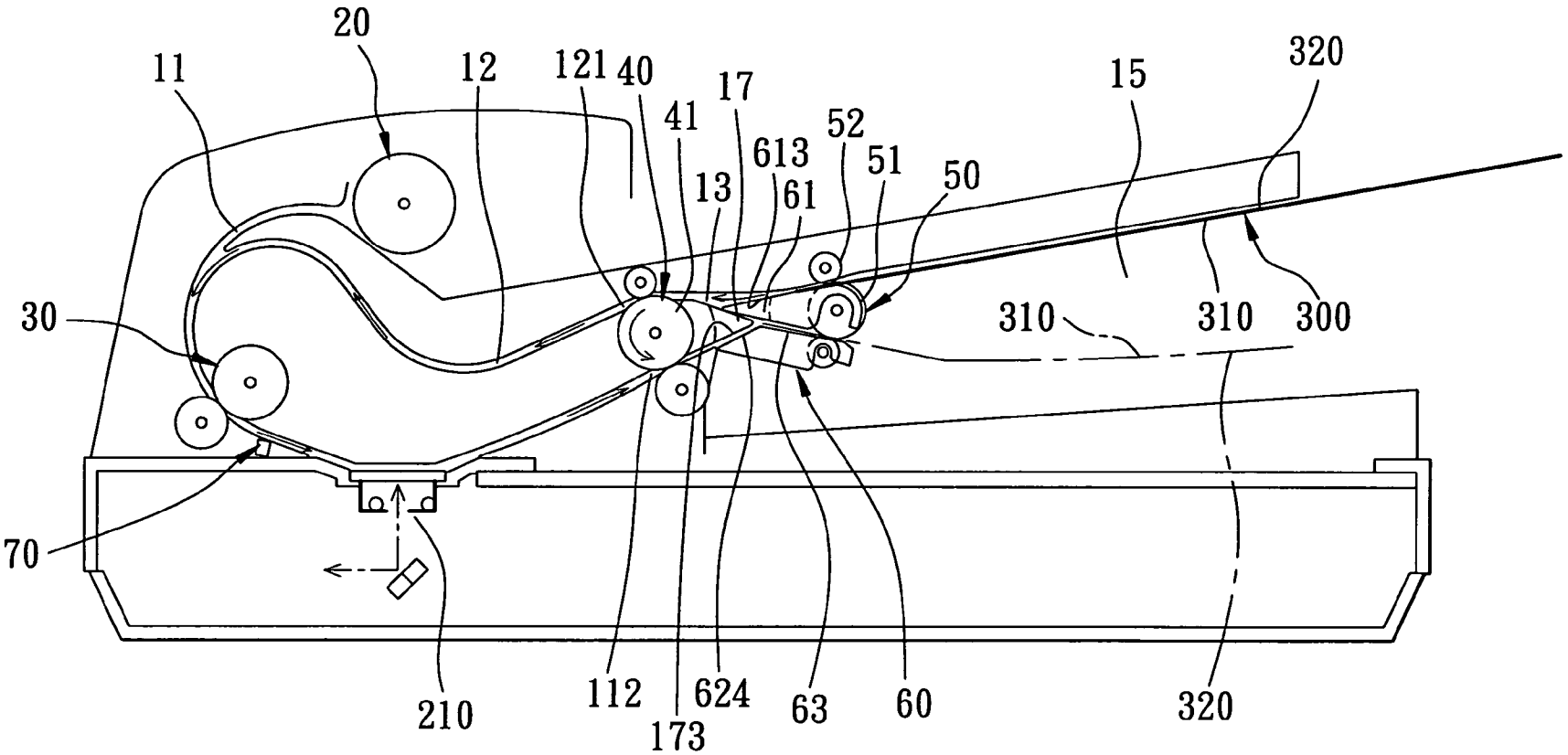
FIG. 4 is a schematic view of the preferred embodiment when the switching unit is disposed in a second position.

With further reference to FIG. 4, when the sensing unit 70 detects the absence of the uppermost document 300 for a predetermined time following the above detection of the presence of the uppermost document 300, which indicates that a trailing end of the uppermost document 300 has passed through the guiding member 17 for a predetermined time period, under the control of the controller, the rotational direction of the second driving roller 51 is reversed (i.e., rotated counterclockwise), and the switching unit 60 is pivoted to the second position. In the second position, the free end of the first switching gate 61 is disposed in proximity to the inlet end 121 such that the inlet end 121 is in spatial communication with the first guiding surfaces 613 of the first switching gate 61. Also in the second position, the second guiding surface 624 is spaced apart from, and adjacent and parallel to the bottom surface 173 of the guiding member 17 so as to define therebetween a document path in spatial communication with the document-discharging end 112 and the guiding path 63. In other words, the document-discharging end 112 and the guiding path 63 are in spatial communication with each other via the second guiding surface 624. As such, the uppermost document 300 is moved from the switchback path 13 into the documents-conveying path 11 via the inverting path 12.

Thereafter, the uppermost document 300 is passed again through the scanning unit 210 so as to scan the second surface 320, and is moved by the ejecting roller unit 40 and the switchback roller unit 50 into the switchback space 15 via the guiding path 63 such that the uppermost document 300 is passed partially through the nip defined between the second driving roller 51 and the upper follower roller 52. At this time, the second surface 320 faces downwardly, and the first surface 310 faces upwardly.

Figure 5:
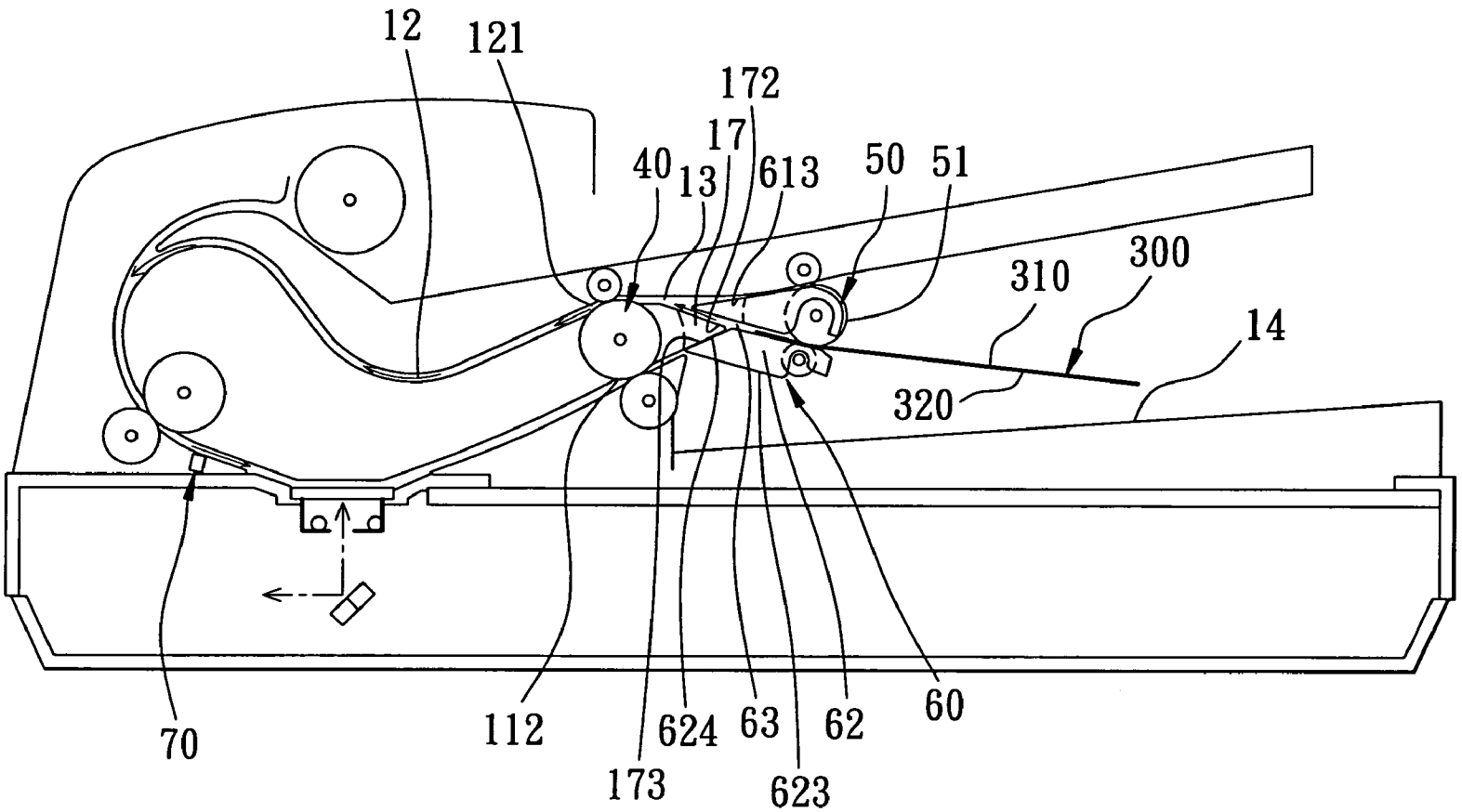
FIG. 5 is a schematic view of the preferred embodiment when the switching unit is disposed in a third position.

With additional reference to FIG. 5, when the sensing unit 70 detects that absence of the uppermost document 300 for a predetermined time following a detection thereof during the above second pass, which indicates that the trailing end of the uppermost document 300 has passed through the guiding member 17 for the predetermined time period, under control of the controller, the switching unit 60 is pivoted to the third position, and the rotational direction of the second driving roller 51 is reversed again (i.e., rotated clockwise). In the third position, the guiding path 63 is aligned with the inlet end 121 such that the inlet end 121 is in spatial communication with the guiding path 63 via the top surface 172 of the guiding member 17, and the second guiding surface 624 of the second switching gate 62 abuts against the bottom surface 173 of the guiding member 17 such that the document-discharging end 112 is in spatial communication with the ejecting tray 14 via the lower guiding surface 623 of the second switching gate 62. As such, the uppermost document 300 is moved again into the inverting path 12 via the guiding path 63.

With additional reference to FIG. 6, the uppermost document 300 is subsequently moved from the inverting path 12 into the document-conveying path 11, and drops from the document-discharging end 112 onto the ejecting tray 14 such that the first surface 310 faces downwardly, and the second surface 320 faces upwardly. As such, when all of the documents 300 are ejected, they are arranged orderly.

In view of the above, the duplex document feeder of this invention has the following advantages:

(1) Since the switching unit 60 is pivotable among the first, second, and third positions, the documents 300 can be arranged orderly when ejected. Furthermore, the switching unit 60 has a simple structure, and is able to be assembled with ease, thereby reducing the manufacturing costs of the duplex document feeder.

(2) The documents 300 can be moved smoothly along the document-conveying path 11, the inverting path 12, the switchback path 13, and the guiding path 63. Thus, the documents 300 do not experience paper jam and curling problems when ejected.

Figure 6:
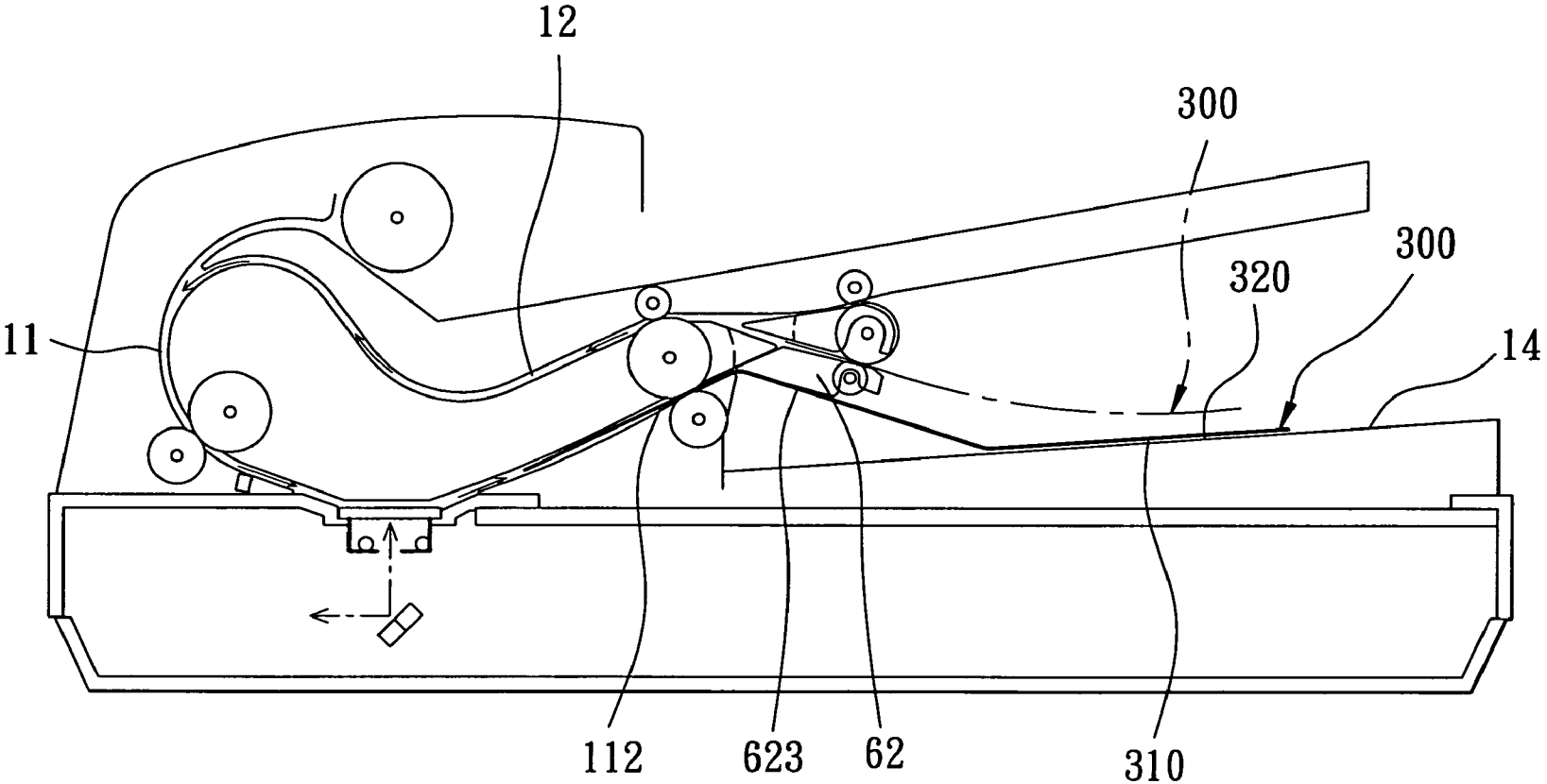
FIG. 6 is a schematic view of the preferred embodiment, illustrating how a document is ejected.

(3) With particular reference to FIGS. 5 and 6, after completion of scanning of the second surface 320 of the document 300, the leading end of the document 300 is ejected along the lower guiding surface 623 of the second switching gate 62. Thus, even if the trailing end of the document 300 remains in the guiding path 63 at the time the leading end of the document 300 is ejected, a paper jam resulting from overlapping of the leading and trailing ends of the document 300 can be prevented. Furthermore, since the duplex document feeder of this invention does not have the annular document path occurring in the duplex document feeder disclosed in U.S. Pat. No. 5,784,680, each of the document-conveying path 11 and the inverting path 12 is allowed to be short. Thus, the whole length and volume of the duplex document feeder can be reduced.

With this invention thus explained, it is apparent that numerous modifications and variations can be made without departing from the scope and spirit of this invention. It is therefore intended that this invention be limited only as indicated by the appended claims.

We claim:

1. A duplex document feeder adapted for an image forming apparatus, the image forming apparatus including a scanning unit, said duplex document feeder comprising:

a housing unit having a document-conveying path, an inverting path in spatial communication with an intermediate portion of said document-conveying path, and a switchback path located at one side of an assembly of said document-conveying path and said inverting path, said document-conveying path having a document-feeding end and a document-discharging end, said inverting path having an inlet end aligned with said document-discharging end, and an outlet end in spatial communication with said document-conveying path, said switchback path being in spatial communication with said document-discharging end and said inlet end, the scanning unit being disposed between said outlet end and said document-discharging end; and a switching unit disposed pivotally in said switchback path and including a first switching gate, a second switching gate connected fixedly to and disposed under said first switching gate, and a guiding path disposed between said first and second switching gates, said switching unit being pivotable in said switchback path among a first position whereat a free end of said first switching gate is disposed under said document-discharging end such that a top portion of said first switching gate is in spatial communication with both said document-discharging end and said inlet end, a second position whereat said free end of said first switching gate is disposed in proximity to said inlet end such that said inlet end is in spatial communication with said top portion of said first switching gate and whereat said document-discharging end is in spatial communication with said guiding path, and a third position whereat said guiding path is aligned with said inlet end such that said inlet end is in spatial communication with said guiding path and whereat said document-discharging end is in spatial communication with a bottom portion of said second switching gate.

2. The duplex document feeder as claimed in claim 1, wherein said housing unit further has an ejecting tray external to said document-conveying path, and a switchback space disposed directly above said ejecting tray.

3. The duplex document feeder as claimed in claim 1, further comprising a feeding roller unit disposed at said document-feeding end, a conveying roller unit disposed in said document-conveying path and disposed between said document-feeding end and said document-discharging end, and an ejecting roller unit disposed in said switchback path.

4. The duplex document feeder as claimed in claim 3, wherein said ejecting roller unit includes a first driving roller and two first follower rollers located respectively to two opposite sides of said first driving roller such that, when said first driving roller is rotated in a direction, said first follower rollers rotate in an opposite direction.

5. The duplex document feeder as claimed in claim 1, further comprising a switchback roller unit disposed in proximity to said switching unit.

6. The duplex document feeder as claimed in claim 5, wherein said switchback roller unit includes a second driving roller and a pair of upper and lower follower rollers disposed respectively above and under said second driving roller such that, when said second driving roller is rotated in a direction, said upper and lower follower rollers rotate in an opposite direction, said first switching gate being coaxial with said second driving roller, said second switching gate being coaxial with said lower follower roller, said guiding path being aligned with a nip defined between said second driving roller and said lower follower roller.

7. The duplex document feeder as claimed in claim 6, wherein said housing unit further has a triangular guiding member disposed between and in proximity to said inlet end and said document-discharging end, said guiding member extending into said switchback path and having a plurality of spaced-apart guiding paws interconnected fixedly, said first switching gate having a plurality of first paw plates, said first paw plates and said guiding paws being alternately arranged, said second switching gate having a second paw plate having an area corresponding to a total area of said first paw plates.

8. The duplex document feeder as claimed in claim 7, wherein said guiding member of said housing unit has a top surface disposed in proximity to said inlet end, and a bottom surface disposed in proximity to the document-discharging end, each of said first paw plates having a first guiding surface disposed at said top portion thereof such that, when said switching unit is disposed in said first position, said document-discharging end and said inlet end are in spatial communication with said first guiding surface.

9. The duplex document feeder as claimed in claim 8, wherein said second paw plate of said switching unit has a lower guiding surface distal from said guiding path, and a second guiding surface disposed between said guiding path and said lower guiding surface such that, when said switching unit is disposed in said second position, said inlet end is in spatial communication with said guiding path, and said document-discharging end is in spatial communication with said guiding path via said second guiding surface, and when said switching unit is disposed in said third position, said inlet end is in spatial communication with said guiding path via said top surface of said guiding member, said second guiding surface abuts against said bottom surface of said guiding member, and said document-discharging end is in spatial communication with said lower guiding surface of said second switching gate.

10. The duplex document feeder as claimed in claim 1, further comprising a sensing unit adapted to be disposed in said document-conveying path between said conveying roller unit and the scanning unit.

* * * * *